US012121156B1

(12) United States Patent
Wu

(10) Patent No.: US 12,121,156 B1
(45) Date of Patent: Oct. 22, 2024

(54) FOLDABLE SOFA ARMREST AND SOFA

(71) Applicant: Shanghai Wudi Home Furnishings Co Ltd, Shanghai (CN)

(72) Inventor: Peng Wu, Shanghai (CN)

(73) Assignee: Shanghai Wudi Home Furnishings Co Ltd, Shanghai (CN)

( * ) Notice: Subject to any disclaimer, the term of this patent is extended or adjusted under 35 U.S.C. 154(b) by 0 days.

(21) Appl. No.: 18/424,891

(22) Filed: Jan. 29, 2024

(30) Foreign Application Priority Data

Aug. 22, 2023 (CN) ..... 202322271398.X

(51) Int. Cl.

| | |
|---|---|
| ***A47C 7/54*** | (2006.01) |
| ***A47C 4/28*** | (2006.01) |
| ***A47C 17/04*** | (2006.01) |
| ***A47C 17/86*** | (2006.01) |

(52) U.S. Cl.
CPC ..... *A47C 7/543* (2013.01); *A47C 4/283* (2013.01); *A47C 7/546* (2013.01); *A47C 17/04* (2013.01); *A47C 17/86* (2013.01)

(58) Field of Classification Search
CPC ..... A47C 7/543; A47C 4/283; A47C 7/546; A47C 17/04; A47C 17/86; E05D 11/10; E05D 11/1007; E05D 11/1014; E05D 11/1028; E05D 11/1078; E05D 11/06
USPC ..... 297/411.23, 440.1, 440.14; 135/143, 135/144, 146, 157; 119/474, 499; 16/319, 338–340, 344, 349, 353, 374, 389
See application file for complete search history.

(56) References Cited

U.S. PATENT DOCUMENTS 357,188 A * 2/1887 Edmondson et al. .. E05D 11/06 16/345
1,788,490 A * 1/1931 Lewis ..... E05D 3/02 16/374
2,737,311 A * 3/1956 Blacher ..... A45C 13/04 16/374
3,048,883 A * 8/1962 Rizzuto ..... E05D 11/1007 16/353
3,874,398 A * 4/1975 Hendrickson ..... E04H 15/001 135/144
3,950,758 A * 4/1976 Mirrione ..... H01Q 1/08 403/92

(Continued)

FOREIGN PATENT DOCUMENTS

CN 303800314 S 8/2016

*Primary Examiner* — Robert Canfield
(74) *Attorney, Agent, or Firm* — Bayramoglu Law Offices LLC

(57) ABSTRACT

A foldable sofa armrest and a sofa are provided. The foldable sofa armrest includes an armrest frame and an armrest skin, where the armrest skin covers an outer surface of the armrest frame; the armrest frame includes a first frame, a second frame, and a folding part; the folding part includes a first folding member, a second folding member, and a connecting component; the first folding member is provided on the first frame; the second folding member is provided on the second frame; the armrest frame has a first state and a second state; in the first state, the connecting component securely connects the first folding member to the second folding member; and in the second state, the first folding member and the second folding member are rotatable relative to each other. The sofa armrest is allowed to be in an unfolded or folded state.

16 Claims, 11 Drawing Sheets

(56) References Cited

U.S. PATENT DOCUMENTS 4,003,455 A * 1/1977 Cortese ..... A47C 4/52 383/29
4,077,418 A * 3/1978 Cohen ..... E04H 15/48 135/95
4,286,612 A * 9/1981 Neal ..... E04H 15/56 135/130
4,540,306 A * 9/1985 Wang ..... E06C 1/32 16/334
5,251,359 A * 10/1993 Finkl ..... E05D 11/06 16/349
5,343,887 A * 9/1994 Danaher ..... E04H 15/40 135/156
5,956,810 A * 9/1999 Spaeth ..... E05D 11/06 16/358
7,802,540 B2 * 9/2010 Jakubowski ..... A01K 1/0254 119/497
9,028,016 B2 * 5/2015 Glenn, Jr. ..... A47B 43/00 312/257.1
11,193,300 B2 * 12/2021 Thomas ..... E04H 1/1277
11,406,192 B1 * 8/2022 Wu ..... A47C 7/42
11,707,138 B1 * 7/2023 Wu ..... A47C 7/546 5/12.1
2005/0046260 A1 * 3/2005 Yamashita ..... A47C 1/026 297/361.1
2005/0217713 A1 * 10/2005 Chu ..... E04H 15/48 135/144
2007/0079858 A1 * 4/2007 Chu ..... A63H 33/008 135/136
2009/0165730 A1 * 7/2009 Farmer ..... A01K 1/0035 135/144
2011/0169304 A1 * 7/2011 Chen ..... A47C 4/283 297/35
2012/0023706 A1 * 2/2012 Fuller ..... E05D 11/06 16/374
2014/0299596 A1 * 10/2014 Kochanowski ..... B65D 88/524 220/1.5
2017/0204663 A1 * 7/2017 Miao ..... E06C 7/50

* cited by examiner

FOLDABLE SOFA ARMREST AND SOFA

CROSS REFERENCE TO THE RELATED APPLICATIONS

This application is based upon and claims priority to Chinese Patent Application No. 202322271398.X, filed on Aug. 22, 2023, the entire contents of which are incorporated herein by reference.

TECHNICAL FIELD

The present disclosure relates to the technical field of home furnishing, and in particular to a foldable sofa armrest and a sofa.

BACKGROUND

As a commonly used furniture in people's work and life, a sofa is an upholstered seat formed with springs or thick foam paddings and provided with a backrest and armrests on two sides for more than one person. A sofa is a large type of furniture and takes up a lot of space.

Chinese patent with the publication No. CN303800314S discloses a sofa, which includes a sofa base, a sofa backrest, and sofa armrests. The sofa armrests are fixedly connected to the sofa base and are formed into an integrated and fixedly connected structure, as shown in FIG. 1.

The integrated and fixedly connected sofa armrests in the prior art cannot be folded during transportation and storage, occupying a large space and increasing storage and transportation costs. In addition, the transportation of the sofa armrests requires a significant amount of manpower and material resources and is time-consuming.

SUMMARY

In view of the defects in the prior art, an objective of the present disclosure is to provide a foldable sofa armrest and a sofa.

The foldable sofa armrest includes an armrest frame and an armrest skin, where the armrest skin covers an outer surface of the armrest frame; the armrest frame includes a first frame, a second frame, and a folding part; the folding part includes a first folding member, a second folding member, and a connecting component; the first folding member is provided on ('lean Version of Substitute Specification the first frame; the second folding member is provided on the second frame; the armrest frame has a first state and a second state; in the first state, the connecting component securely connects the first folding member to the second folding member; and in the second state, the first folding member and the second folding member are rotatable relative to each other.

Preferably, the connecting component includes a rotating connector and a fastener; in the first state, the rotating connector connects the first folding member to the second folding member, and the fastener fixes the first folding member to the second folding member; and in the second state, the rotating connector rotatably connects the first folding member to the second folding member.

Preferably, the fastener includes a screw; an end of the first folding member rotatably connected to the second folding member is provided with a first threaded hole; an end of the second folding member rotatably connected to the first folding member is provided with a second threaded hole; in the first state, the screw is threaded from the first threaded hole into the second threaded hole and threaded through the first threaded hole and the second threaded hole.

Preferably, the connecting component includes a plurality of screws; an end of the first folding member rotatably connected to the second folding member is provided with a plurality of first threaded holes; an end of the second folding member rotatably connected to the first folding member is provided with a plurality of second threaded holes; in the first state, each of the screws corresponds to one first threaded hole and one second threaded hole; and the screw is threaded through the first threaded hole and the second threaded hole.

Preferably, the first folding member is provided with a first stopper, and the second folding member is provided with a second stopper; and in the first state, the first stopper is abutted against the first frame, and the second stopper is abutted against the second frame.

Preferably, an end of the first folding member away from the second folding member is provided with a bending part; and in the first state, a connection point between the bending part and the first frame is at a same height as a connection point between the second folding member and the second frame.

Preferably, there are a plurality of folding parts provided on two sides of the armrest frame; and the folding parts provided on either side are symmetrical.

Preferably, a gasket is further provided between the first threaded hole and the second threaded hole in the first state.

Preferably, zippers are provided on two sides of the armrest skin; and edges of the armrest skin are provided with edge coverings for wrapping outer surfaces of the first frame and the second frame.

The present disclosure further provides a sofa, including the above-mentioned foldable sofa armrest.

Compared with the prior art, the present disclosure has the following beneficial effects:

1. In the present disclosure, the foldable sofa armrest is provided with a folding part, which includes a first folding member, a second folding member, and a connecting component. The connecting component causes the sofa armrest to be in an unfolded or folded state. In the folded state, the sofa armrest takes up little space, making it easy to transport and store and reducing transportation and storage costs.
2. In the present disclosure, the first folding member and the second folding member are respectively provided with a first stopper and a second stopper, which play a stopping role.
3. In the present disclosure, a bending part is provided at an end of the first folding member away from the second folding member. In the unfolded state, the connection point between the bending part and the first frame is at a same height as the connection point between the second folding member and the second frame, ensuring a balanced and stable sofa armrest.

BRIEF DESCRIPTION OF THE DRAWINGS

Other features, objectives, and advantages of the present disclosure will become more apparent by reading the detailed description of non-limiting embodiments with reference to the following drawings.

Figure 1:
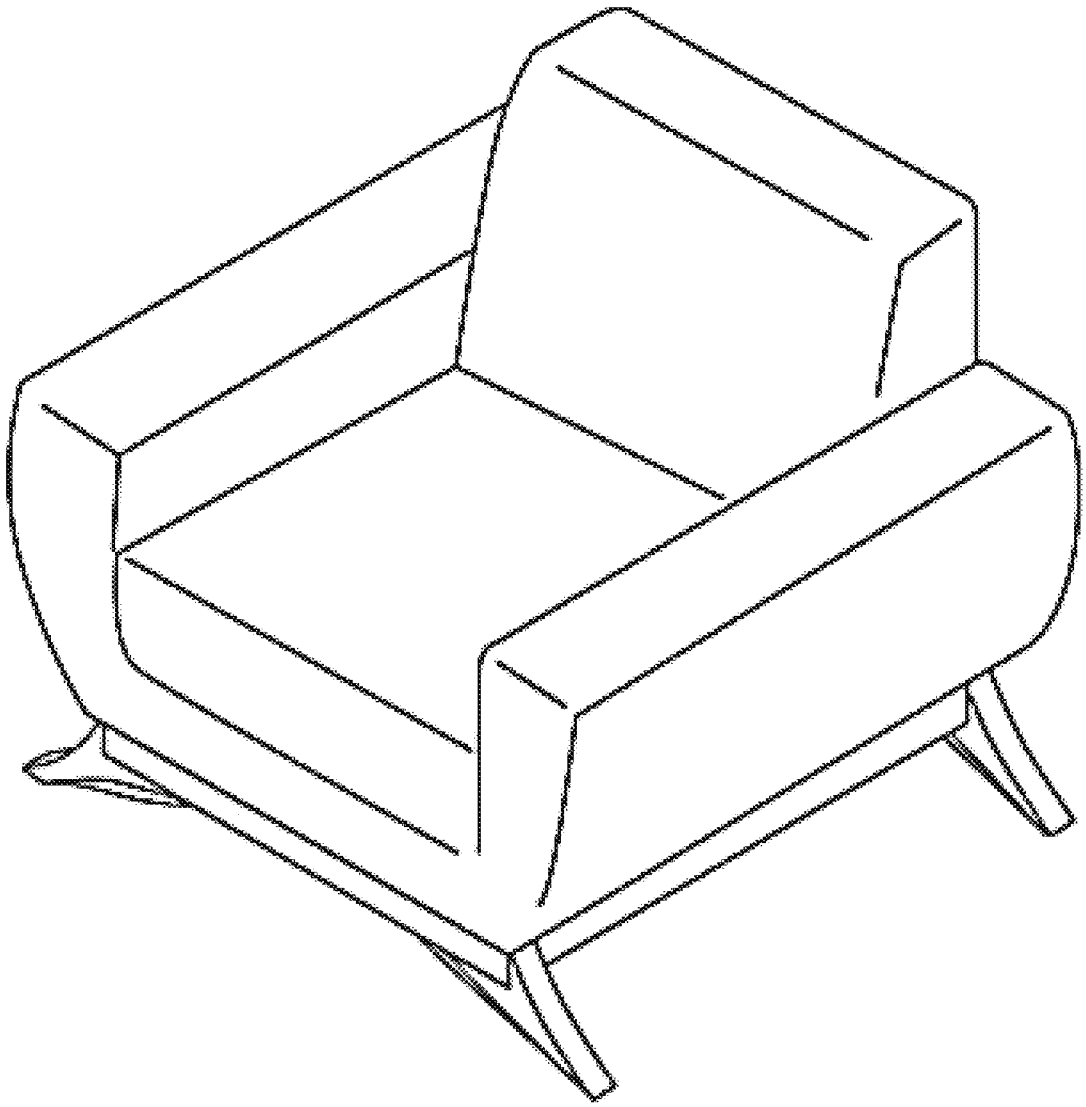
FIG. 1(Prior Art)
FIG. 1 is a schematic diagram of integrated and fixedly sofa armrests in the prior art.

| Reference Numerals: |
|---|
| 1. first frame; |
| 2. second frame; |
| 3. first folding member; |
| 4. second folding member; |
| 5. first threaded hole; |
| 6. second threaded hole; |
| 7. first stopper; |
| 8. second stopper; |
| 9. screw; |
| 10. bending part; |
| 11. gasket; |
| 12. armrest skin; |
| 13. webbing; |
| 14. connecting component; |
| 15. rotating connector; |
| 16. zipper; |
| 17. fastener; |
| 18. folding part; |
| 19. sofa body; |
| 20. sofa; |
| 21. connecting component; |
| 22. folding part. |

DETAILED DESCRIPTION OF THE EMBODIMENTS

The following describes the present disclosure in detail in conjunction with particular embodiments. The following embodiments will be conducive to further understanding of the present disclosure by a person of ordinary skill in the art, but does not limit the present disclosure in any form. It should be noted that several variations and improvements can also be made by a person of ordinary skill in the art without departing from the conception of the present disclosure. These variations and improvements shall fall within the protection scope of the present disclosure.

Embodiment 1

As shown in FIGS. 2 to 8, the present disclosure provides a foldable sofa armrest, including an armrest frame and armrest skin 12. The armrest skin 12 covers an outer surface of the armrest frame. The armrest frame includes first frame 1, second frame 2, and a folding part 18. The folding part 18 includes first folding member 3, second folding member 4, and a connecting component 14. The first folding member 3 is provided on the first frame 1, and the second folding member 4 is provided on the second frame 2. The armrest frame has a first state and a second state. In the first state, the connecting component 14 securely connects the first folding member 3 to the second folding member 4. In the second state, the first folding member 3 and the second folding member 4 are rotatable relative to each other.

In the first state, the connecting component 14 securely connects the first folding member 3 to the second folding member 4, and the folding part 18 unfolds the first frame 1 and the second frame 2, such that the sofa armrest is in an unfolded state. In the second state, the first folding member 3 and the second folding member 4 are rotatable relative to each other, and the relative positions of the first frame 1 and the second frame 2 are not fixed, making the sofa armrest in a foldable state. In the present disclosure, during use, the sofa armrest can be in an unfolded state and can be used normally. Besides, the sofa armrest is in a foldable state during transportation or storage, reducing space occupation, facilitating transportation and storage, and reducing transportation and storage costs.

Figure 3:
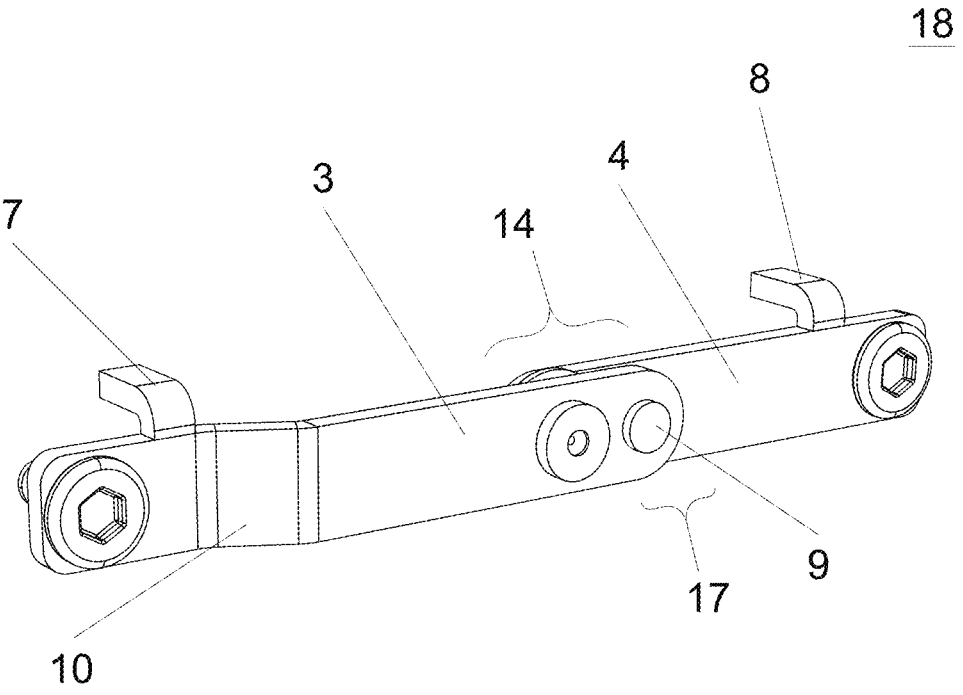
FIG. 3 is a structural diagram of a folding part when a sofa armrest is in an unfolded state according to the present disclosure.
Figure 4:
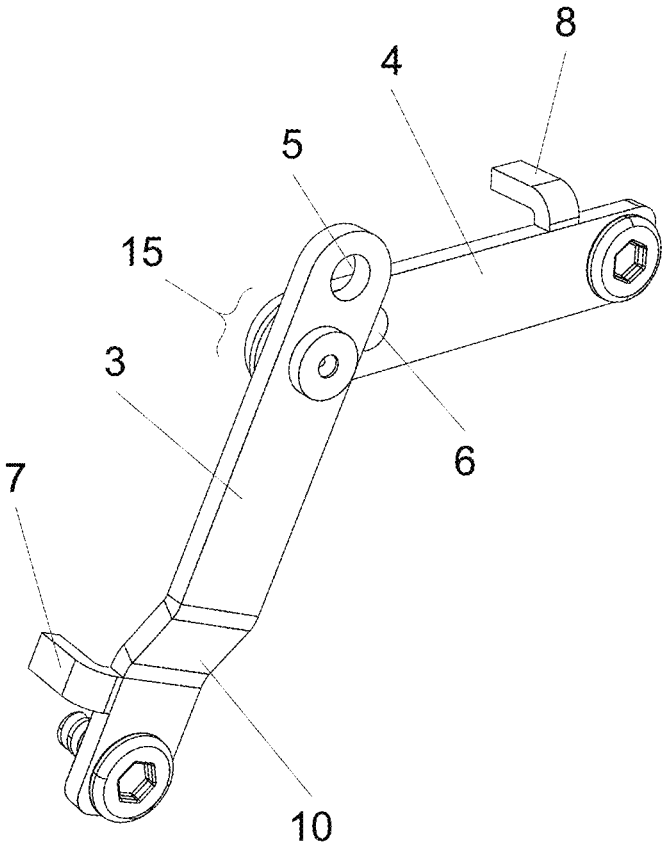
FIG. 4 is a structural diagram of the folding part when the sofa armrest is in a folded state according to the present disclosure.

Specifically, as shown in FIGS. 3 and 4, the connecting component 14 includes a rotating connector 15 and a fastener 17. In the first state, the rotating connector 15 connects the first folding member 3 to the second folding member 4, and the fastener 17 fixes the first folding member 3 to the second folding member 4. In the second state, the rotating connector 15 rotatably connects the first folding member 3 to the second folding member 4. In the first state, the first foldable member 3 and the second foldable member 4 are connected through a rotating shaft, forming a connection point between the first foldable member 3 and the second foldable member 4. The first folding member 3 and the second folding member 4 are fixed through the fastener 17, forming another connection point between the first folding member 3 and the second folding member 4. The two connection points and the fastener 17 work together to support the first frame 1 and the second frame 2, causing the sofa armrest to be in an unfolded state. In the second state, the first folding member 3 and the second folding member 4 are connected through the rotating shaft. There is only one connection point between the first folding member 3 and the second folding member 4. The first folding member 3 and the second folding member 4 are rotatable relative to each other, and the relative positions of the first frame 1 and the second frame 2 are not fixed. Therefore, the sofa armrest is in a foldable state.

More specifically, the fastener 17 includes screw 9. An end of the first folding member 3 rotatably connected to the second folding member 4 is provided with first threaded hole 5, and an end of the second folding member 4 rotatably connected to the first folding member 3 is provided with second threaded hole 6. In the first state, the first threaded hole 5 and the second threaded hole 6 are coaxial, and the screw 9 is threaded through the first threaded hole 5 and the second threaded hole 6. In the first state, the first folding member 3 and the second folding member 4 are rotatably connected by the rotating shaft. The screw 9 is threaded from the first threaded hole 5 into the second threaded hole 6 or the screw 9 is threaded from the second threaded hole 6 into the first threaded hole 5. In this way, the screw 9 fixes the first folding member 3 and the second folding member 4 together, and the first frame 1 and the second frame 2 are unfolded. For transportation or storage, the screw 9 is removed, such that the first folding member 3 and the second folding member 4 are rotatable relative to each other. Then the first frame 1 and the second frame 2 are movable close to each other to make the sofa armrest in a foldable state.

In a preferred implementation, the first folding member 3 is provided with first stopper 7, and the second folding member 4 is provided with second stopper 8. In the first state, the first stopper 7 is abutted against the first frame 1, and the second stopper 8 is abutted against the second frame 2. The first stopper 7 and the second stopper 8 play a stopping role.

The first folding member 3 and the second folding member 4 have a certain thickness. When the sofa armrest is in an unfolded state, in order to make the sofa armrest more stable and balanced, an end of the first folding member 3 is provided with bending part 10. Specifically, an end of the first folding member 3 away from the second folding member 4 is provided with the bending part 10. In the first state, the connection point between the bending part 10 and the first frame 1 is at a same height as the connection point between the second folding member 4 and the second frame 2. Furthermore, there are a plurality of folding parts provided on two sides of the armrest frame. The folding parts provided on either side are symmetrical to further ensure the stability and balance of the sofa armrest.

In the first state, gasket 11 is further provided between the first threaded hole 5 and the second threaded hole 6. The gasket 11 is preferably made of a plastic to prevent the sofa armrest from loosening during movement.

Figure 2:
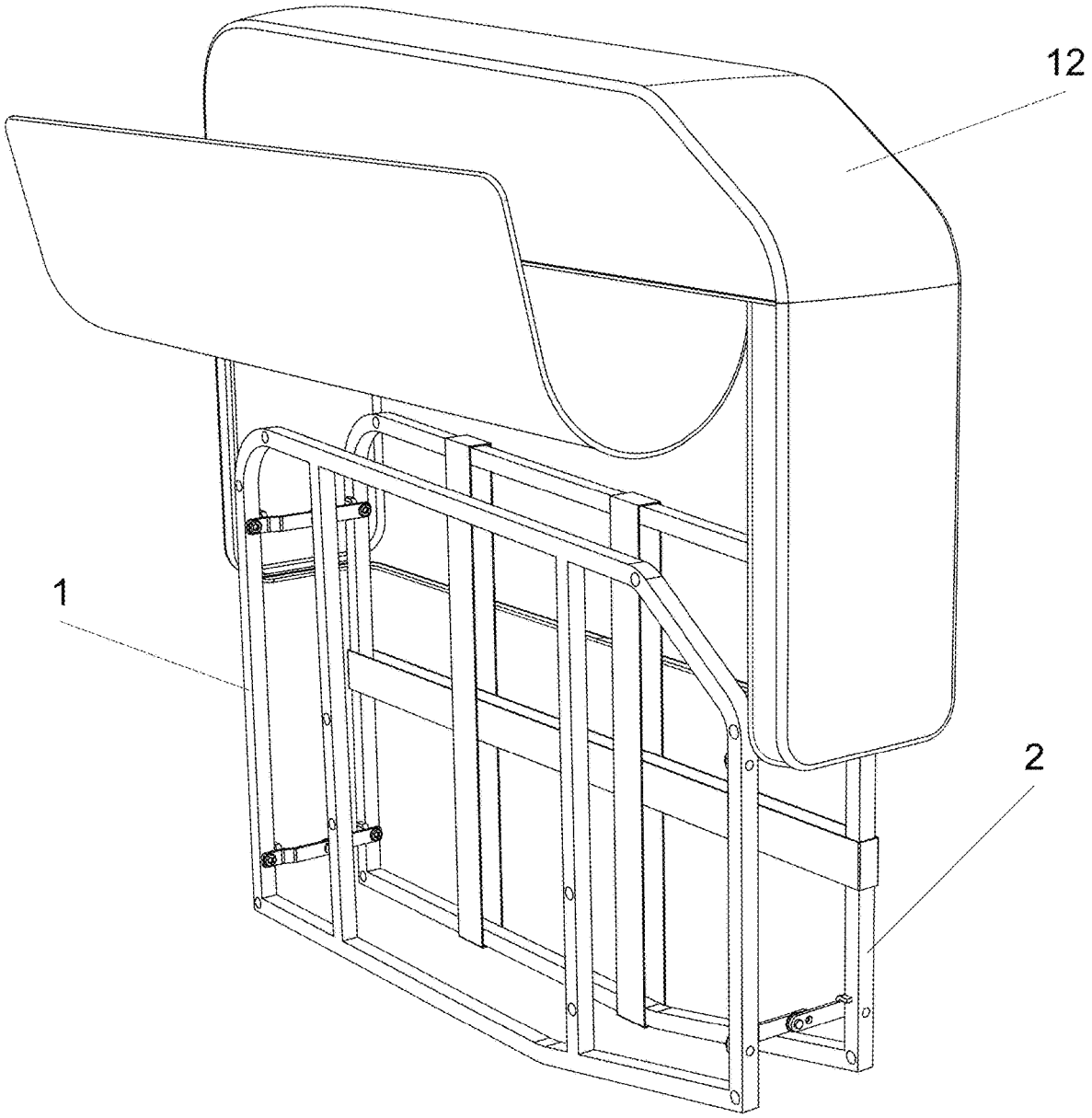
FIG. 2 is an exploded view of an armrest frame and an armrest skin according to the present disclosure.
Figure 10:
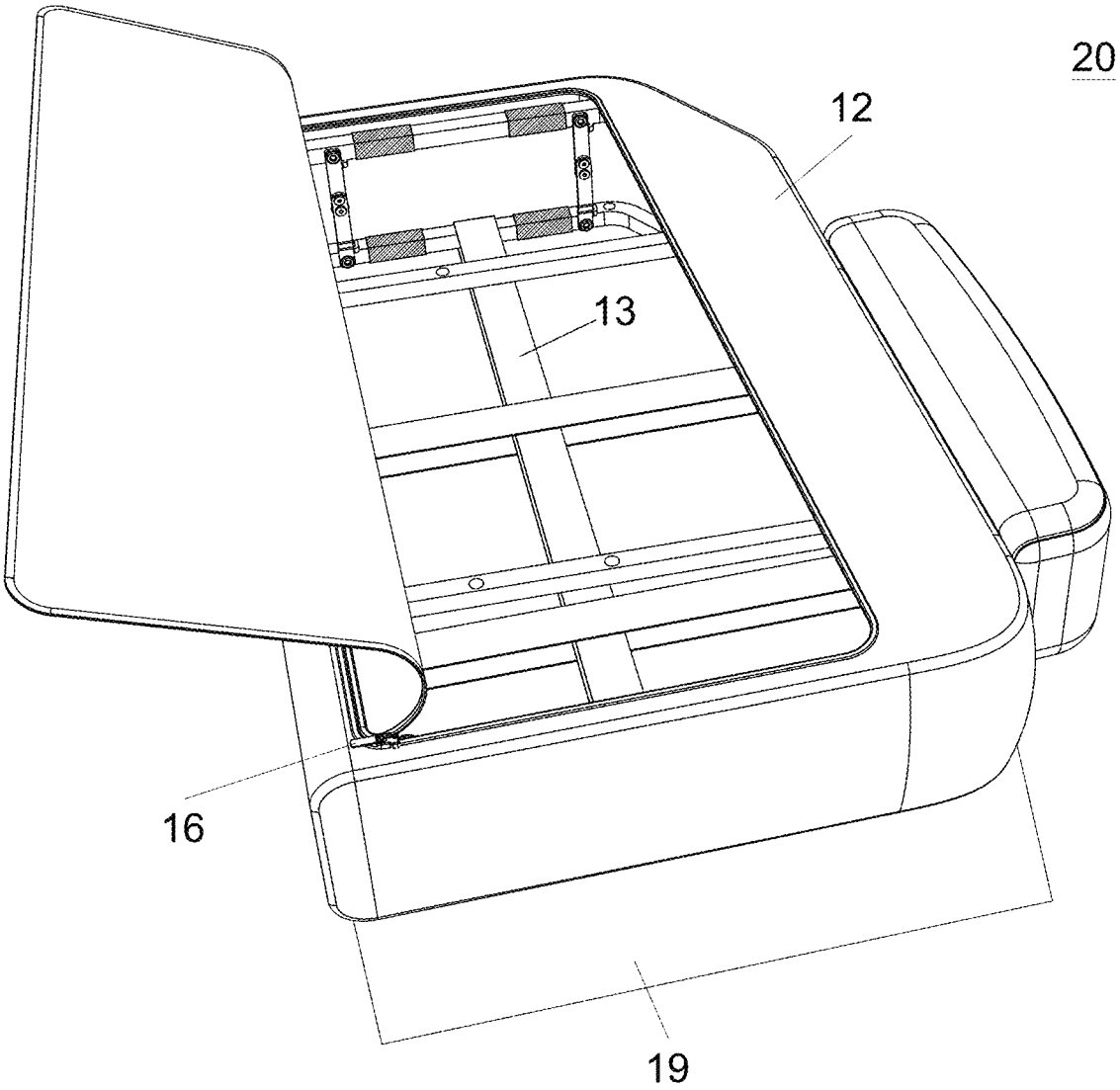
FIG. 10 is a schematic diagram showing that, after the armrest skin is covered, the sofa armrest can be opened through a zipper on a side and assembled from a folded state to an unfolded state according to the present disclosure.
Figure 11:
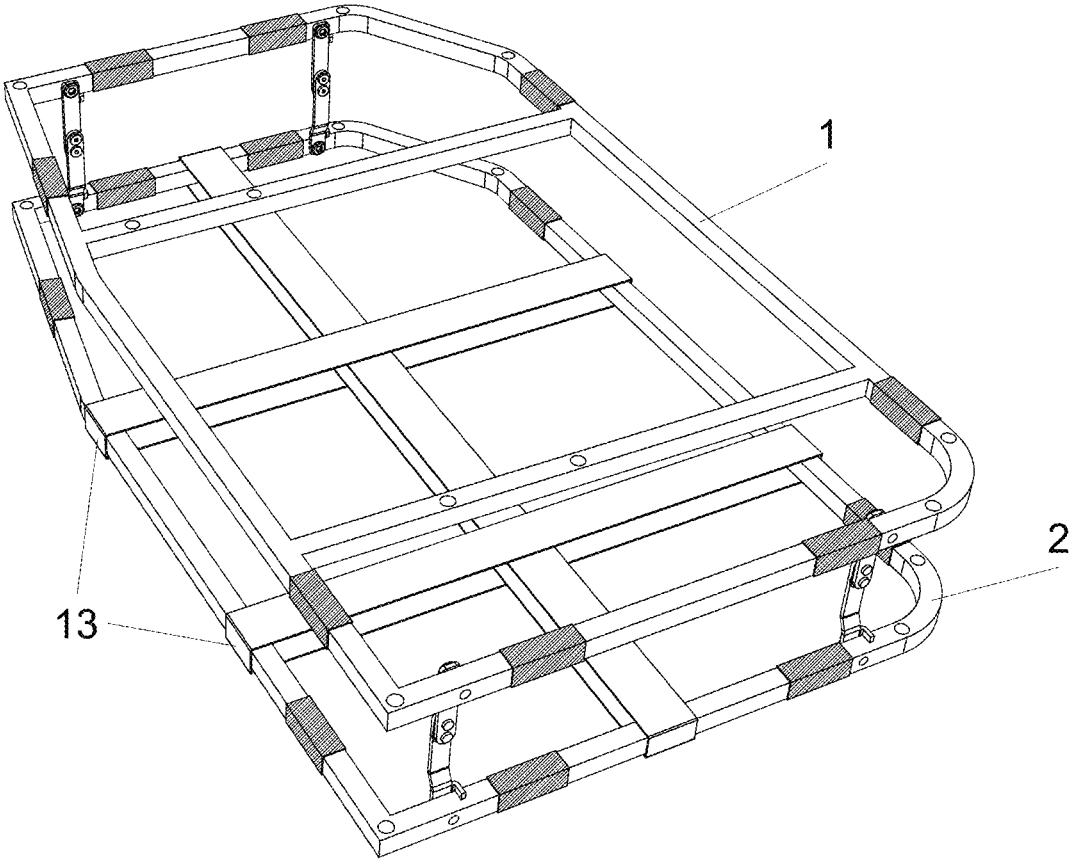
FIG. 11 is a detailed diagram of the sofa armrest in an unfolded state according to the present disclosure.

As shown in FIGS. 2 and 10, in order to facilitate the removal of the armrest skin 12 from the sofa frame, zippers 16 are provided on two sides of the armrest skin 12. Edges of the armrest skin 12 are provided with edge coverings for wrapping outer surfaces of the first frame 1 and the second frame 2.

The first frame 1 is detachably connectable to the sofa base, and the second frame 2 is provided with a plurality of webbings 13. The plurality of webbings 13 intersect with each other. When the sofa is assembled, the sofa armrest is fixed to the sofa base through the first frame 1, and the second frame 2 is not fixedly connected to the sofa base. To save production costs, the second frame 2 can only include a perimeter frame, and the plurality of webbings 13 are provided on the perimeter frame. The plurality of webbings 13 intersect with each other to reduce collapse of the armrest skin 12 caused by touch.

The present disclosure further provides a sofa 20, including a sofa body 19 and the above-mentioned foldable sofa armrest.

Embodiment 2

Figure 5:
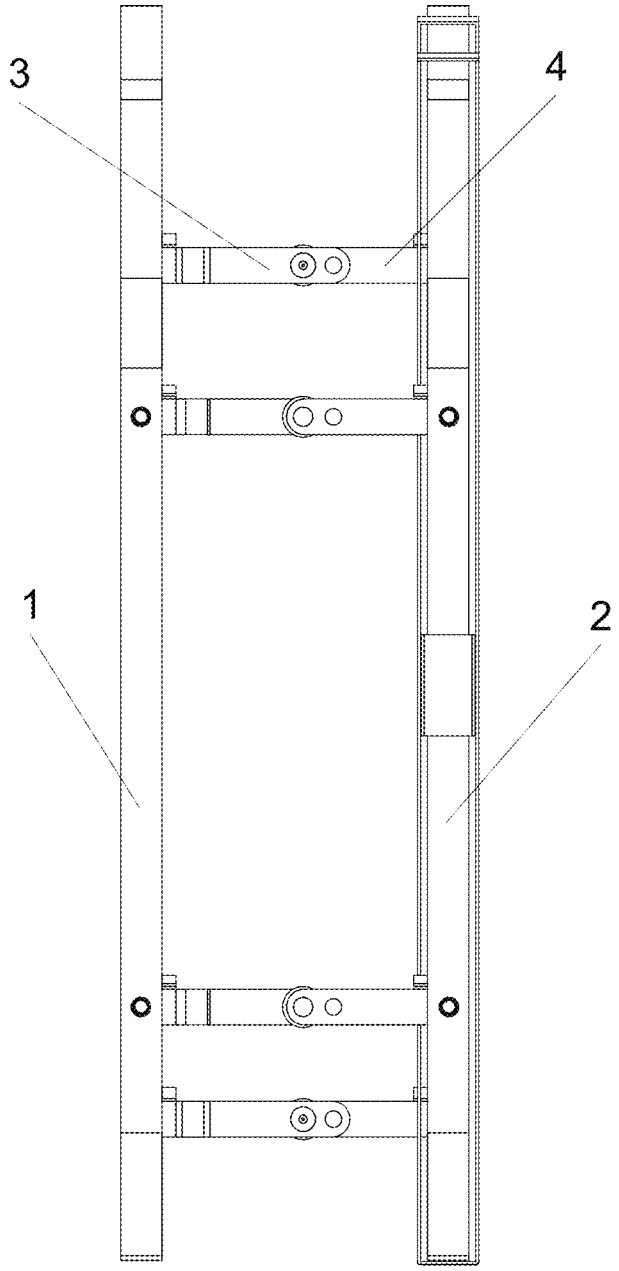
FIG. 5 is a lateral view of the armrest frame when the sofa armrest is in an unfolded state according to the present disclosure.
Figure 6:
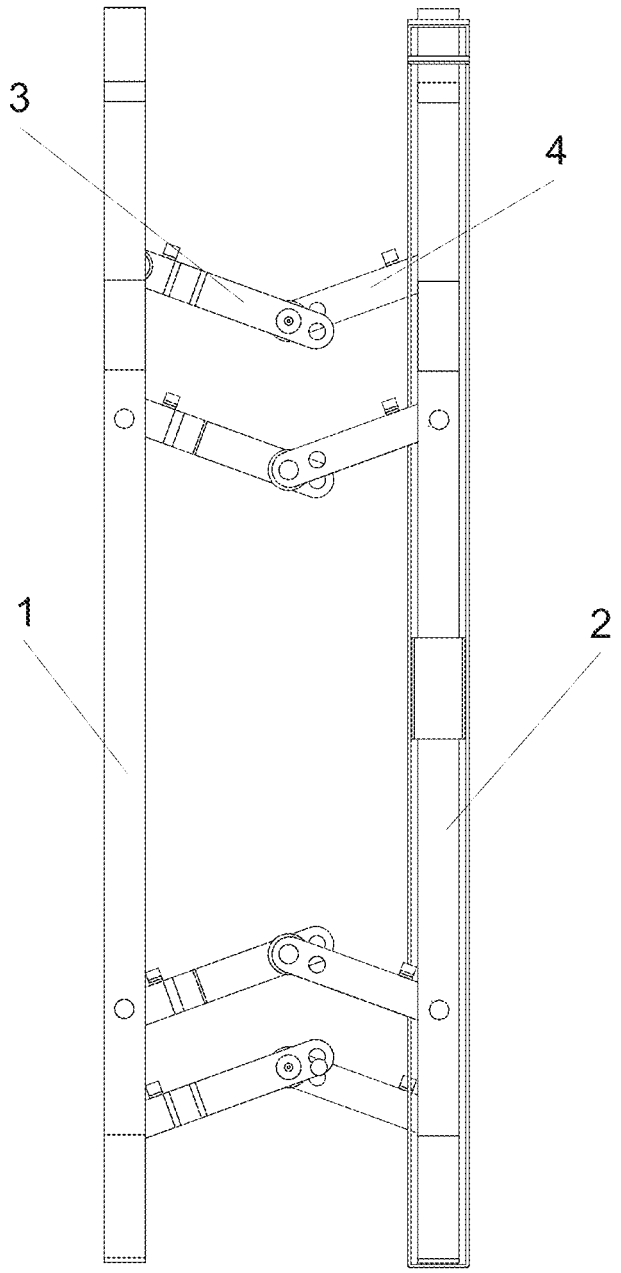
FIG. 6 is a lateral view of the armrest frame when the sofa armrest is in a folded state according to the present disclosure.
Figure 7:
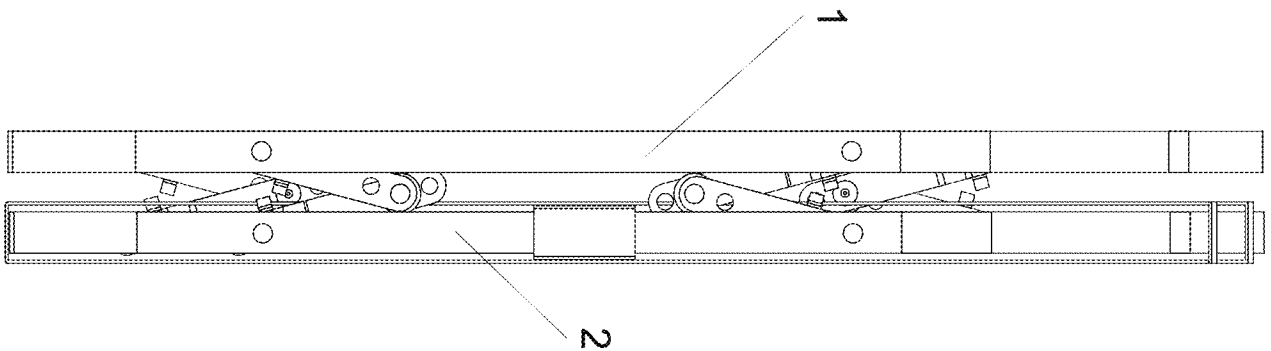
FIG. 7 is a lateral view of the armrest frame when the sofa armrest is in a folded state according to the present disclosure.
Figure 9:
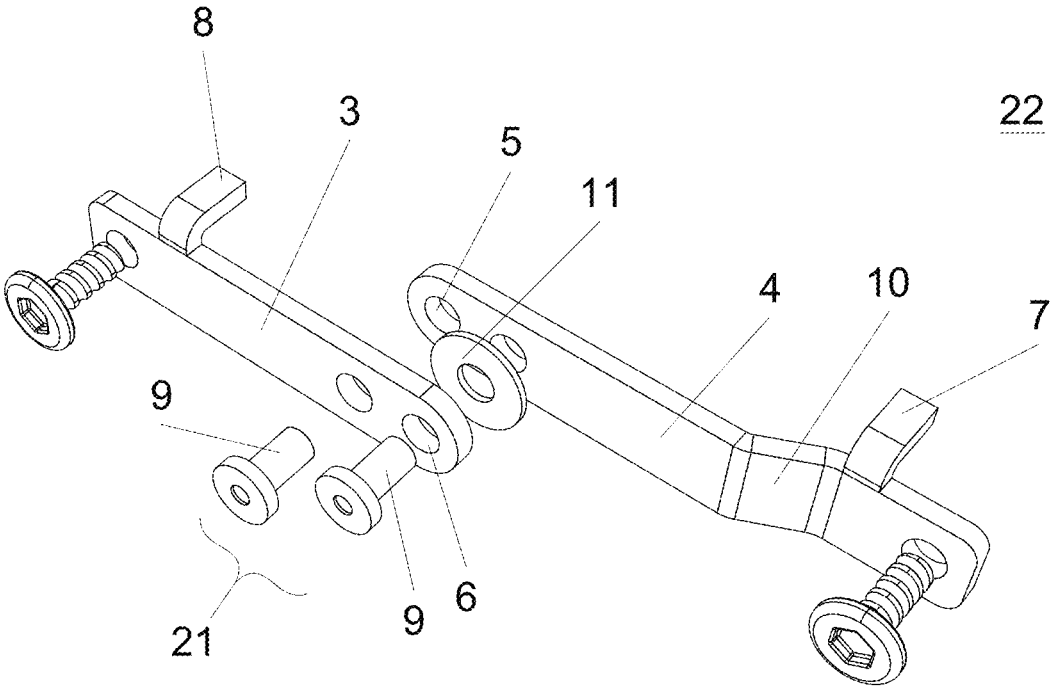
FIG. 9 is an exploded view of the folding part when the sofa armrest is in an unfolded state according to the present disclosure.

As shown in FIGS. 2, 5, and 9, the present disclosure provides a foldable sofa armrest, including an armrest frame and armrest skin 12. The armrest skin 12 covers an outer surface of the armrest frame. The armrest frame includes first frame 1, second frame 2, and a folding part 22. The folding part 22 includes first folding member 3, second folding member 4, and a connecting component 21. The first folding member 3 is provided on the first frame 1, and the second folding member 4 is provided on the second frame 2. The armrest frame has a first state and a second state. In the first state, the connecting component 21 securely connects the first folding member 3 to the second folding member 4. In the second state, the first folding member 3 and the second folding member 4 are rotatable relative to each other.

In the first state, the connecting component 21 securely connects the first folding member 3 to the second folding member 4, and the folding part unfolds the first frame 1 and the second frame 2, such that the armrest frame is in an unfolded state. In the second state, the first folding member 3 and the second folding member 4 are rotatable relative to each other, and the relative positions of the first frame 1 and the second frame 2 are not fixed, making the armrest frame in a foldable state. In the present disclosure, during use, the sofa armrest can be in an unfolded state and can be used normally. Besides, the sofa armrest is in a foldable state during transportation or storage, reducing space occupation, facilitating transportation and storage, and reducing transportation and storage costs.

Specifically, as shown in FIG. 9, the connecting component 21 includes a plurality of screws 9. An end of the first folding member 3 connected to the second folding member 4 is provided with first threaded holes 5, and an end of the second folding member 4 connected to the first folding member 3 is provided with second threaded holes 6. There are a plurality of first threaded holes 5 and a plurality of second threaded holes 6. In the first state, each of the screws 9 corresponds to one first threaded hole 5 and one second threaded hole 6. The first threaded hole 5 and the second threaded hole 6 are coaxial, and the screw 9 is threaded through the first threaded hole 5 and the second threaded hole 6. For example, the connecting component 21 includes two screws 9. In the first state, the two screws 9 are threaded from the first threaded holes 5 into the second threaded holes 6 or are threaded from the second threaded holes 6 into the first threaded holes 5. In this way, the two screws 9 fix the first folding member 3 and the second folding member 4 together, forming two connection points. The first frame 1 and the second frame 2 keep away from each other, and the sofa armrest is in an unfolded state. For transportation or storage, the two screws 9 are removed, such that the first folding member 3 and the second folding member 4 are disconnected. Then the first frame 1 and the second frame 2 are movable close to each other to make the sofa armrest in a foldable state.

In a preferred implementation, the first folding member 3 is provided with first stopper 7, and the second folding member 4 is provided with second stopper 8. In the first state, the first stopper 7 is abutted against the first frame 1, and the second stopper 8 is abutted against the second frame 2. The first stopper 7 and the second stopper 8 play a stopping role.

The first folding member 3 and the second folding member 4 have a certain thickness.

When the sofa armrest is in an unfolded state, in order to make the sofa armrest more stable and balanced, an end of the first folding member 3 is provided with bending part 10. Specifically, an end of the first folding member 3 away from the second folding member 4 is provided with the bending part 10. In the first state, the connection point between the bending part 10 and the first frame 1 is at a same height as the connection point between the second folding member 4 and the second frame 2. Furthermore, there are a plurality of folding parts provided on two sides of the armrest frame. The folding parts provided on either side are symmetrical to further ensure the stability and balance of the sofa armrest.

In the first state, gasket 11 is further provided between the first threaded hole 5 and the second threaded hole 6. The gasket 11 is preferably made of a plastic to prevent the sofa armrest from loosening during movement.

As shown in FIGS. 2 and 10, in order to facilitate the removal of the armrest skin 12 from the sofa frame, zippers 16 are provided on two sides of the armrest skin 12. Edges of the armrest skin 12 are provided with edge coverings for wrapping outer surfaces of the first frame 1 and the second frame 2.

Figure 8:
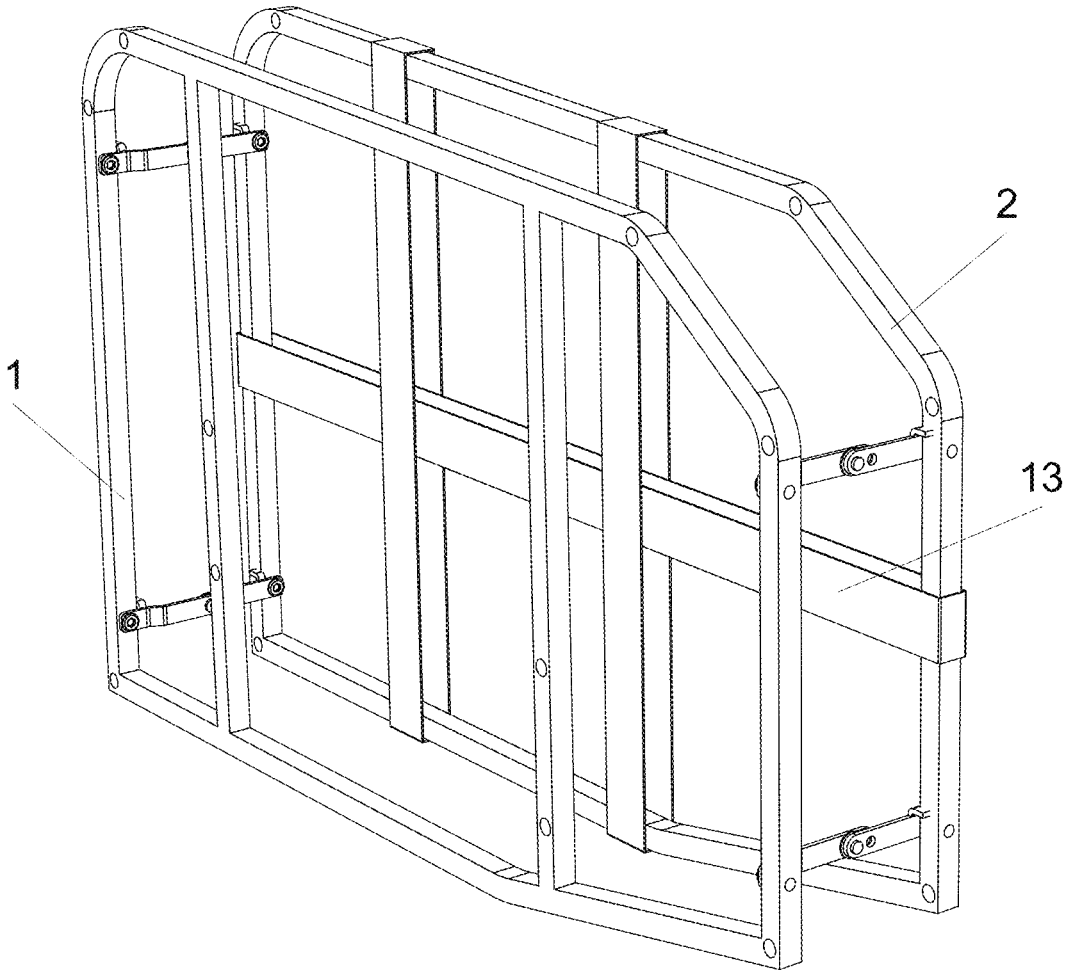
FIG. 8 is a stereoscopic view of the armrest frame when the sofa armrest is in an unfolded state according to the present disclosure.

As shown in FIG. 8, the first frame 1 is detachably connected to the sofa base, and the second frame 2 is provided with a plurality of webbings 13. The plurality of webbings 13 intersect with each other. When the sofa is in use, the sofa armrest is fixed to the sofa base through the first frame 1, and the second frame 2 is not fixedly connected to the sofa base. To save production costs, the second frame 2 can only include a perimeter frame, and the plurality of webbings 13 are provided on the perimeter frame. The plurality of webbings 13 intersect with each other to reduce collapse of the armrest skin 12 caused by touch.

The present disclosure further provides a sofa 20, including a sofa body 19 and the above-mentioned foldable sofa armrest.

In the description of the present application, it needs to be understood the orientation or positional relationships indicated by terms, such as "up", "down", "front", "rear", "left", "right", "vertical", "horizontal", "top", "bottom", "inside", and "outside", are based on the orientation or positional relationship shown in the accompanying drawings, are merely for facilitating the description of the present application and simplifying the description, rather than indicating or implying that an apparatus or element referred to must have a particular orientation or be constructed and operated in a particular orientation, and therefore shall not be interpreted as limiting the present application.

The particular embodiments of the present disclosure are described as above. It should be understood that the present disclosure is not limited to the above specific embodiments. Those skilled in the art can make various changes or modifications within the scope of the claims, which does not affect the essence of the present disclosure. The embodiments of the present disclosure and features in the embodiments may be arbitrarily combined with each other in a non-conflicting situation.

What is claimed is:

1. A foldable sofa armrest, comprising an armrest frame and an armrest skin, wherein the armrest skin covers an outer surface of the armrest frame;

the armrest frame comprises a first frame, a second frame, and a folding part; the folding part comprises a first folding member, a second folding member, and a connecting component; the first folding member is provided on the first frame; and the second folding member is provided on the second frame; and the armrest frame has a first state and a second state; in the first state, the connecting component securely connects the first folding member to the second folding member; and in the second state, the first folding member and the second folding member are rotatable relative to each other, wherein the connecting component comprises a rotating connector and a fastener; in the first state, the rotating connector connects the first folding member to the second folding member, and the fastener fixes the first folding member to the second folding member; and in the second state, the rotating connector rotatably connects the first folding member to the second folding member wherein the fastener comprises a screw; an end of the first folding member rotatably connected to the second folding member is provided with a first threaded hole; and an end of the second folding member rotatably connected to the first folding member is provided with a second threaded hole; and in the first state, the first threaded hole and the second threaded hole are coaxial, and the screw is threaded through the first threaded hole and the second threaded hole.

2. A sofa, comprising:

a sofa body; and a foldable sofa armrest, wherein the foldable sofa armrest comprises an armrest frame and an armrest skin, wherein the armrest skin covers an outer surface of the armrest frame, wherein the armrest frame comprises a first frame, a second frame, and a folding part, wherein the folding part comprises a first folding member, a second folding member, and a connecting component, wherein the first folding member is provided on the first frame, and the second folding member is provided on the second frame, and wherein the armrest frame has a first state and a second state, and in the first state, the connecting component securely connects the first folding member to the second folding member, and in the second state, the first folding member and the second folding member are rotatable relative to each other.

3. The foldable sofa armrest according to claim 1, wherein the first folding member is provided with a first stopper, and the second folding member is provided with a second stopper; and in the first state, the first stopper is abutted against the first frame, and the second stopper is abutted against the second frame.

4. The foldable sofa armrest according to claim 1, wherein a plurality of folding parts are provided on two sides of the armrest frame; and the folding parts provided on either side are symmetrical.

5. The foldable sofa armrest according to claim 1, wherein a gasket is provided between a first threaded hole and a second threaded hole in the first state.

6. The foldable sofa armrest according to claim 1, wherein a zipper is provided on the armrest skin; and edges of the armrest skin are provided with edge coverings for wrapping outer surfaces of the first frame and the second frame.

7. The foldable sofa armrest according to claim 1, wherein the sofa armrest is openable through a zipper on a side of the sofa armrest and is configured to change from a folded state to an unfolded state by mounting four screws.

8. The foldable sofa armrest according to claim 1, A foldable sofa armrest, comprising an armrest frame and an armrest skin, wherein the armrest skin covers an outer surface of the armrest frame;

the armrest frame comprises a first frame, a second frame, and a folding part; the folding part comprises a first folding member, a second folding member, and a connecting component;

the first folding member is provided on the first frame; and the second folding member is provided on the second frame; and the armrest frame has a first state and a second state; in the first state, the connecting component securely connects the first folding member to the second folding member; and in the second state, the first folding member and the second folding member are rotatable relative to each other, wherein an end of the first folding member away from the second folding member is provided with a bending part; and in the first state, a connection point between the bending part and the first frame is at a same height as a connection point between the second folding member and the second frame.

9. The foldable-sofa armrest according to claim 2, wherein the connecting component comprises a plurality of screws; an end of the first folding member is connected to the second folding member in the first state and is provided with a plurality of first threaded holes; and an end of the second folding member is connected to the first folding member in the first state and is provided with a plurality of second threaded holes; and in the first state, each screw of the plurality of screws corresponds to one first threaded hole of the plurality of first threaded holes and one second threaded hole of the plurality of second threaded holes; the first threaded hole and the second threaded hole are coaxial; and the screw is threaded through the first threaded hole and the second threaded hole.

10. The sofa according to claim 2, wherein in the foldable sofa armrest, the connecting component comprises a rotating connector and a fastener; in the first state, the rotating connector connects the first folding member to the second folding member, and the fastener fixes the first folding member to the second folding member; and in the second state, the rotating connector rotatably connects the first folding member to the second folding member.

11. The sofa according to claim 10, wherein the fastener comprises a screw; an end of the first folding member rotatably connected to the second folding member is provided with a first threaded hole; and an end of the second folding member rotatably connected to the first folding member is provided with a second threaded hole; and in the first state, the first threaded hole and the second threaded hole are coaxial, and the screw is threaded through the first threaded hole and the second threaded hole.

12. The sofa according to claim 2, wherein in the foldable sofa armrest, the first folding member is provided with a first stopper, and the second folding member is provided with a second stopper; and in the first state, the first stopper is abutted against the first frame, and the second stopper is abutted against the second frame.

13. The sofa according to claim 2, wherein in the foldable sofa armrest, an end of the first folding member away from the second folding member is provided with a bending part; and in the first state, a connection point between the bending part and the first frame is at a same height as a connection point between the second folding member and the second frame.

14. The sofa according to claim 2, wherein in the foldable sofa armrest, a plurality of folding parts are provided on two sides of the armrest frame; and the folding parts provided on either side are symmetrical.

15. The sofa according to claim 2, wherein in the foldable sofa armrest, a gasket is provided between a first threaded hole and a second threaded hole in the first state.

16. The sofa according to claim 2, wherein in the foldable sofa armrest, a zipper is provided on the armrest skin; and edges of the armrest skin are provided with edge coverings for wrapping outer surfaces of the first frame and the second frame.

* * * * *